United States Patent [19]

Himegi

[11] Patent Number: 4,865,306

[45] Date of Patent: Sep. 12, 1989

[54] FRICTION PAD FIXTURE

[75] Inventor: Tohru Himegi, Osaka, Japan

[73] Assignee: Mita Industrial Co., Ltd., Osaka, Japan

[21] Appl. No.: 160,532

[22] Filed: Feb. 26, 1988

[30] Foreign Application Priority Data

Mar. 2, 1987 [JP] Japan ..... 62-30537
Nov. 30, 1987 [JP] Japan ..... 62-303872

[51] Int. Cl.[4] ..... B65H 3/52
[52] U.S. Cl. ..... 271/121; 271/124
[58] Field of Search ..... 271/121, 124

[56] References Cited

U.S. PATENT DOCUMENTS 3,768,803 10/1973 Stange ..... 271/121

FOREIGN PATENT DOCUMENTS 962706 11/1975 Canada ..... 271/121
145740 8/1986 Japan .

*Primary Examiner*—Kevin P. Shaver
*Assistant Examiner*—Kenneth Noland
*Attorney, Agent, or Firm*—Koda and Androlia

[57] ABSTRACT

The present invention has adopted a fixture as its principle device for urging a friction pad with pressure against the outer circumferential surface of a paper feed roller disposed in an image forming apparatus to prevent duplicated paper feed. The fixture according to the present invention includes a first support member detachably mounted on the body of the image forming apparatus, a second support member for movably carrying the friction pad, and a resilient device for urging the second support member toward the paper feed roller.

2 Claims, 5 Drawing Sheets

FRICTION PAD FIXTURE

BACKGROUND OF THE INVENTION

1. Field of the Invention

This invention relates to a fixture for a friction pad and its operational method used for applying pressure on the circumferential surface of a paper feeding roller provided in image forming apparatus like copiers, printers, facsimile devices and the like to prevent copy papers from being fed in duplication.

2. Description of the Prior Art

There has been conventionally known a fixture arrangement of this kind for a friction pad used for copiers as shown in FIG. 5.

In the conventional fixture arrangement A shown above, as shown in FIG. 5, a friction pad 12 is disposed at a location on a frame 7' which is located opposite to a paper feed roller 8 provided on a snatch frame 7 of a clam shell type. The friction pad 12 is secured to a pad holder 13 that is supported vertically movable in a mounting opening 11 carved on the surface of said frame 7' and is always elastically urged against the paper feed roller 8 by a spring not shown.

At an upper portion of said frame 7' there is provided an advancing feed roller 30 whose outer circumferential surface comes in contact therewith. This advancing feed roller 30 is provided for feeding copying papers carried on a stack table 9 into a nipping area between said paper feed roller 8 and said friction pad 12. There is a well known advancing feed roller 30 such as the one just mentioned, which is actuated to rotate continuously until a copying process has been completed once the copy button is depressed regardless of the presence of copying papers on said stack table 9.

The friction pad 12 is replaced when worn out excessively than the specified amount by the frictional encounter with copying papers to prevent faults such as paper feeding error or abnormal noise.

In the conventional fixture arrangement A thus constructed, however, to replace the friction pad 12 requires the removal of the paper feed roller 8 from the frame 7 and further, the disassembly of parts including a pad holder 13 and the spring not shown within the mounting opening 11 since they are assembled within said mounting opening 11 together with the friction pad 12 as shown above.

This structure necessitates a high skill to replace the friction pad 12, which is then conventionally performed by a service engineer dispatched from a manufacturer involved.

The arrangement of the paper feed roller 8 and the friction pad 12 as shown above aims at sorting a plurality of copying papers inserted between them by the advancing feed roller 30 and advancing only one paper that is nearest the paper feed roller 8 (the uppermost one).

The duplication-free handling of copying papers like this is performed in such a way that the difference in coefficient of friction among the paper feed roller 8, copying paper, and friction pad 12 is utilized to feed the uppermost paper by the paper feed roller 8 while braking is applied to the carry of copying papers by the friction pad 12. Because of this there occurs a duplication paper feed when different frictional forces among these three elements (according to the difference in coefficient of friction) mentioned above change. The difference in these frictional forces will slightly change according to the pressure applied to the paper feed roller 8 by the friction pad 12 (pad pressure), the material of the pad as well as the kind of copying papers used.

However, since a highly skillful technique is required to replace the friction pad in the conventional fixture arrangement for the same, users cannot readily replace the currently used friction pad with the one optimum for another kind of paper to be used or adjust the pad pressure, a service engineer is required every time such an operation is performed.

The present invention is, therefore, aiming at eliminating the above mentioned problems and providing an improved fixture for a friction pad and its operational method in which the replacement of the friction pad or adjustment of the pad pressure is readily performed by an operator without the help of a service engineer.

SUMMARY OF THE INVENTION

To accomplish said object, the present invention has adopted a fixture as its principle device means for urging a friction pad with pressure against the outer circumferential surface of a paper feed roller disposed in an image forming apparatus to prevent duplicated paper feed. The fixture according to the present invention comprises a first support member detachably mounted on the body of said image forming apparatus characterized in that said first support member is provided with a second support member for movably carrying said friction pad together with a resilient means for urging said second support member against said paper feed roller.

The present invention has adopted a method as its principle operational means to replace said friction pad fixture including the resilient means according to operated papers different in kind.

As shown above, in the friction pad fixture thus constructed, the friction pad can be replaced easily by removing said first support member, to which the friction pad fixture is fixed, detachably mounted on said body of the image forming apparatus. Such a replacement method will prevent fault including paper feed failure caused by the abrasion in the friction pad or the first support member and abnormal noise. Further, when said fixture or resilient member is made to be replaced according to various operated papers different in kind, optimum duplicated-feed preventive function may be realized.

BRIEF DESCRIPTION OF THE DRAWINGS

FIG. 2(*b*) is a sectional view along the line C–C' of FIG. 2(*a*);

DETAILED DESCRIPTION OF PREFERRED EMBODIMENT

Referring now to the accompanying drawings one embodiment of the present invention will be described for better understanding of the invention.

The embodiment described here is an example embodying the present invention provided for the purpose of explanation only, and will not limit the claim of the present invention.

Figure 5:
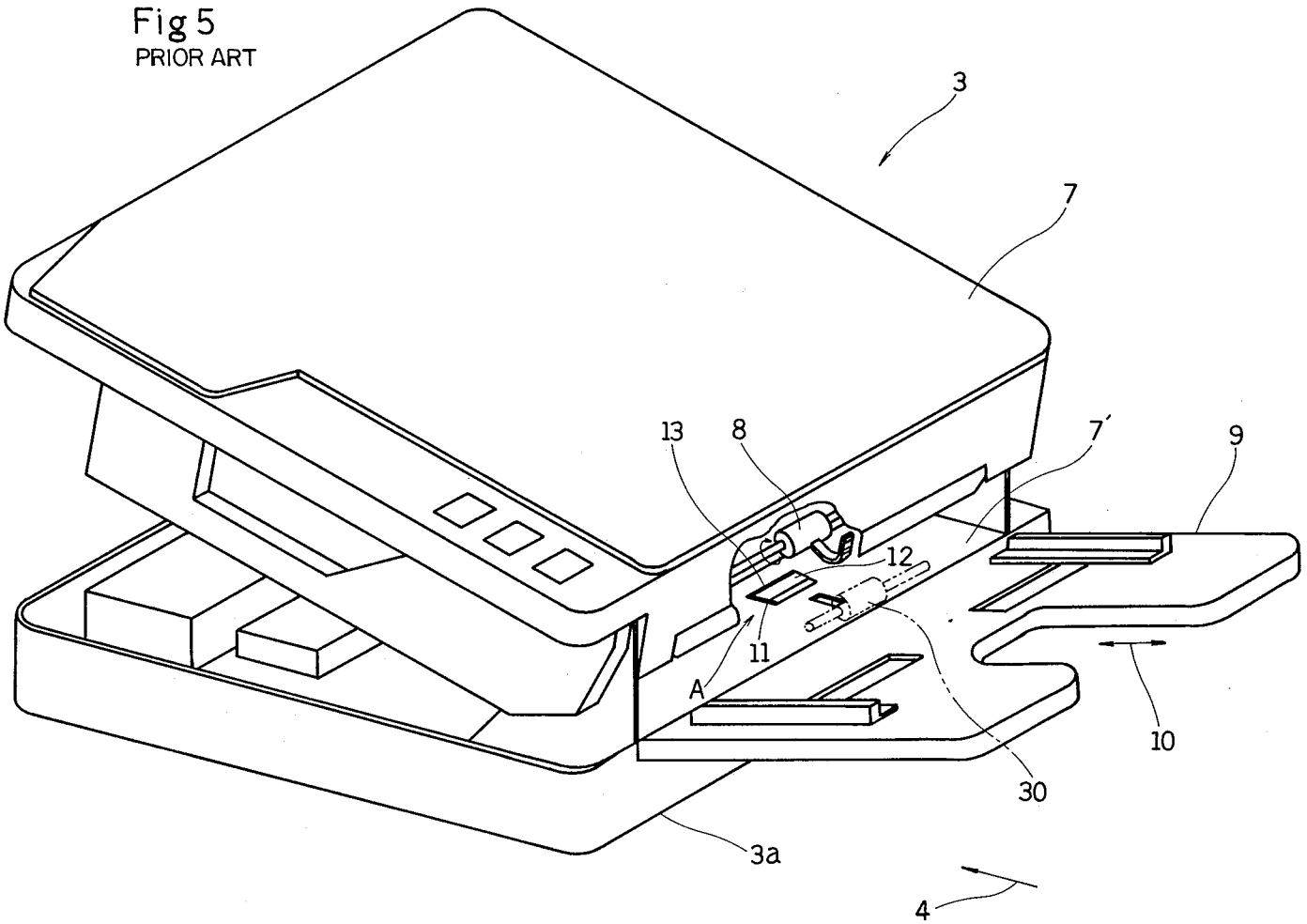
Fig 5 PRIOR ART
FIG. 5 is a perspective view of a copying machine comprising a conventional friction pad fixture.

In the following description, the elements of the embodiment similar to those of the conventional friction pad fixture arrangement A shown in FIG. 5 are given same reference numerals.

Figure 4:
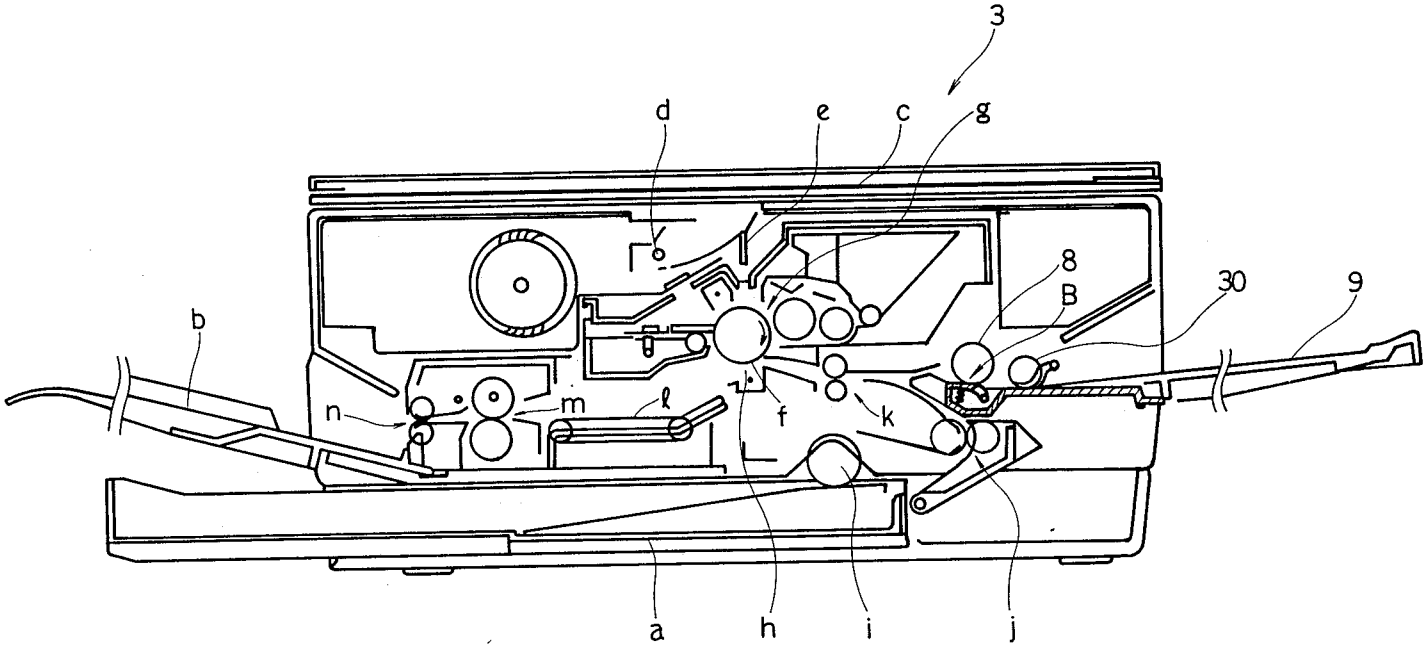
FIG. 4 is a schematic side sectional elevation of the copying machine shown in FIG. 1.

Reference is now given to FIG. 4 showings a copying machine 3 to which the present invention may be applied.

The copying machine 3 is of a simple type which utilizes paper feed by way of a cassette a and a stack table 9 and discharge by a paper discharge tray b which receives copied papers.

The original carried on a moving table c is impinged with a light beam from a light source d, and the light reflected on the surface of the original is focused on the surface of a photosensitive drum f through a lens array to form an electrostatic latent image on the photosensitive surface thereof. The photosensitive drum f rotates clockwise as shown by the arrow in FIG. 4 and said electrostatic latent image is developed into a toner image at a developing portion g, and further carried to a transferring portion h.

Meanwhile, a copying paper fed from the cassette a by a paper feed roller i is turned its travelling direction by approximately 180 degrees at a feed roller j and its leading edge is inserted into resist rollers k. Copying paper fed from the stack table 9 is carried toward a paper feed roller 8 by an advancing feed roller 30 as previously described. The copying paper fed by the paper feed roller 8 is then supplied to said resist rollers k.

Out of the resist rollers k, the paper passes said transferring portion h when the toner image on the surface of the photosensitive drum f is transferred onto the paper. The paper with the toner image is further carried to fixing rollers m through a conveyer belt l where the toner image is fixed on the paper. The paper is then finally discharged to the paper discharge tray b.

Figure 1:
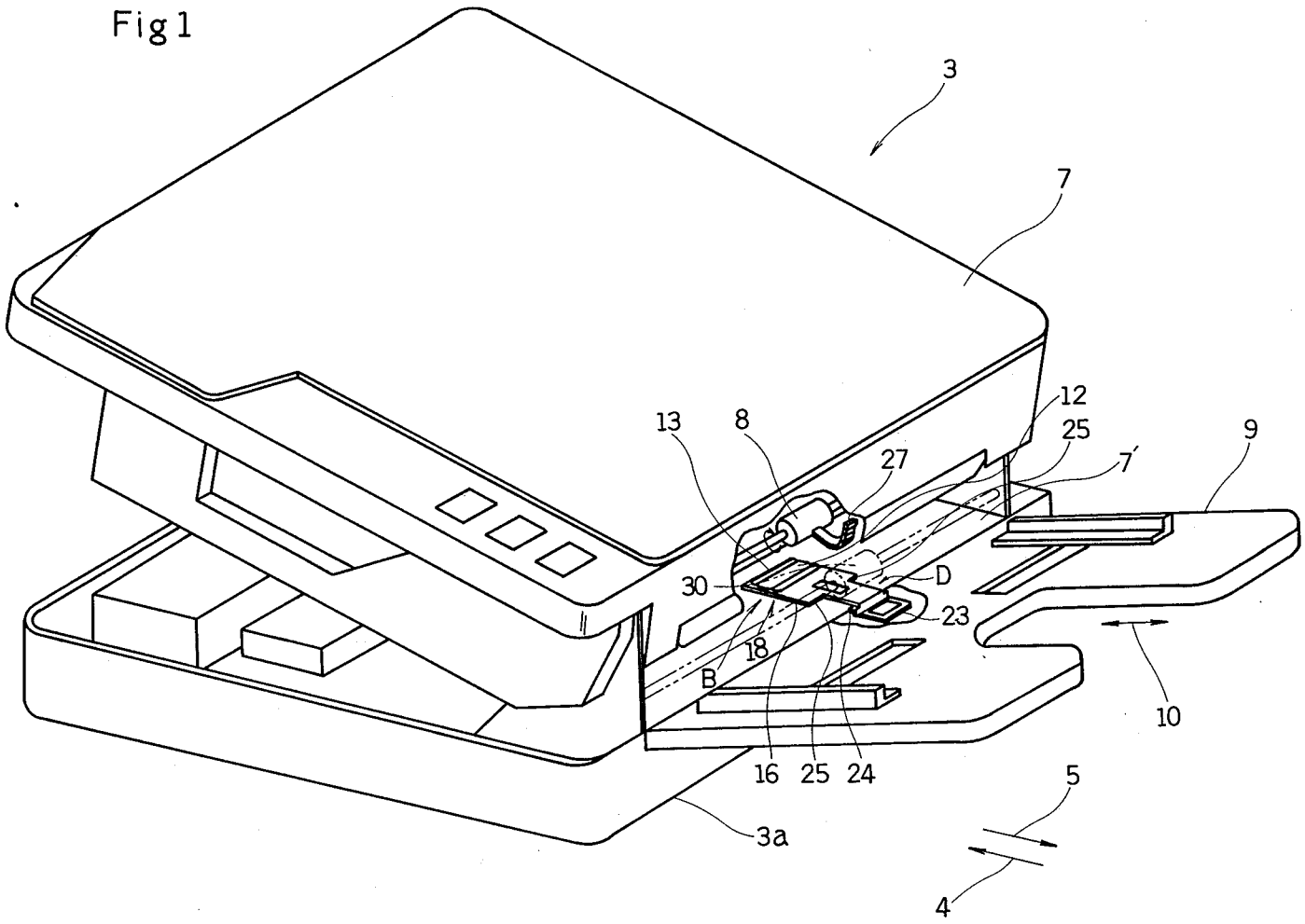
FIG. 1 is a perspective view of a copying machine comprising a friction pad fixture according to one embodiment of the present invention.
Figure 2A:
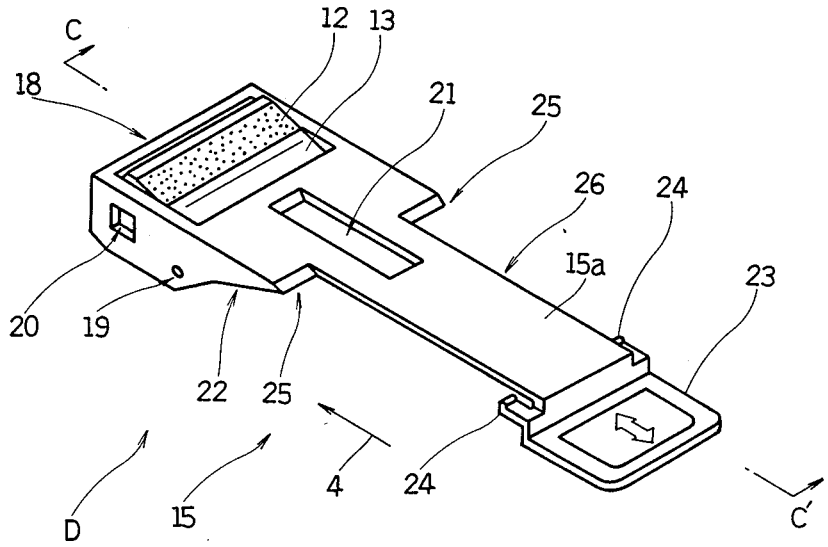
FIG. 2(*a*) is a perspective view of the friction pad fixture of FIG. 1.
Figure 2B:
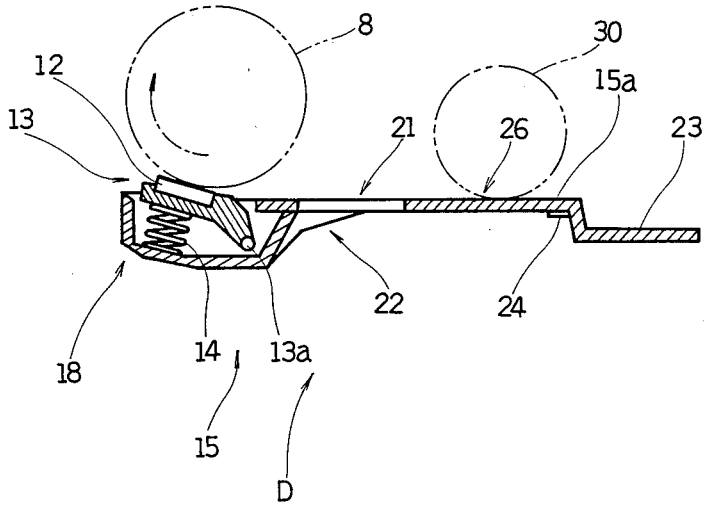

The friction pad fixture B according to this embodiment (hereinafter referred to as "fixture B") is, as shown in FIG. 1, FIG. 2(*a*), FIG. 2(*b*) and FIG. 4, composed of a stack holder (first support member) 15 which is detachably mounted in a mounting opening 16 notched in a frame 7' at a place opposite to a paper feed roller 8 provided in a frame 7, a pad holder 13 (second support member) for movably supporting a friction pad 12 on the stack holder 15, and a spring 14 (resilient means) for urging the pad holder 13 toward said paper feed roller 8 with respect to said stack holder 15.

The stack holder 15 is provided with a housing 18 to hold the friction pad 12, pad holder 13 and spring 14, whose both sides are provided with mounting holes 19 for fitting a shaft 13*a* of the pad holder 13 later described, and engaging holes 20 for fitting pawls 13*b* (see FIG. 3).

A guide portion 22, which is provided on the upstream side in the paper feed direction, to form the bottom surface of said housing 18 is made slanted for ease of removal of the housing 18 from said mounting opening 16, and an upstream end 25 has a tapered surface for preventing the leading edge of the copying paper fed in the direction shown by the arrow 4 from being caught by the end 25.

The housing 18 has at its upper central portion a slot 21 for fitting a switch 27 (see FIG. 1) to detect the presence of the copying paper thereon when the housing 18 is mounted in the mounting opening 16 (see FIG. 1). A supporting portion 26 provided at an upstream location extended from the housing 18 in the paper feed direction has engaging hooks 24 to engage with an end of a body 3*a* for holding the housing 18 on said body 3*a* when the housing 18 is mounted within the mounting opening 16. The supporting portion 26 also has at its extreme end a handle 23.

The advancing feed roller 30 continuously rotates during copying operation with it being in contact with the upper surface of a neck portion 15*a* in the support member 26 of said stack holder 15.

Figure 3:
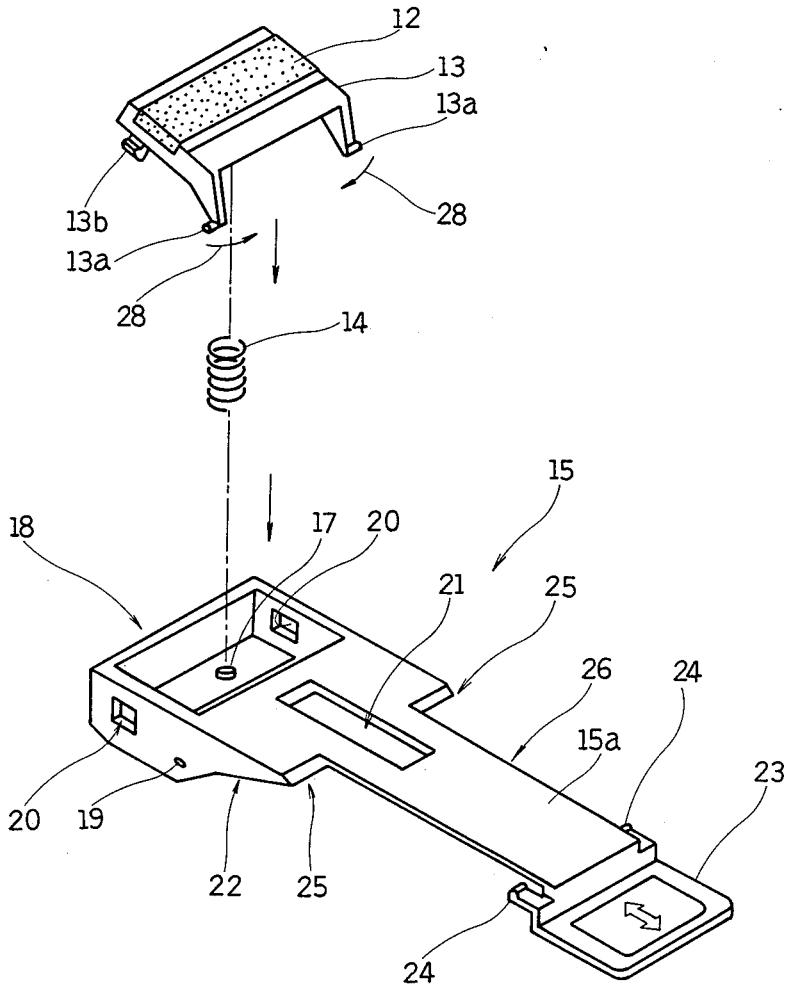
FIG. 3 is an exploded perspective view of the friction pad fixture of FIG. 1.

The pad holder 13 has, as shown in FIG. 2(*a*), FIG. 2(*b*) and FIG. 3, at its upper surface the friction pad 12 secured thereto, and at its both sides said pawls 13*b* formed therewith to engage with said engaging holes 20 of the housing 18 for retaining the pad holder 13 within the housing 18 when it is holded therein. In addition, the pad holder 13 has at its upstream sides said shaft portions 13*a* to be fit into said mounting holes 19 of the housing 18 for swingingly supporting the pad holder 13.

The fixture B is assembled in such a way that the pad holder 13 is mounted on the top end of the spring 14 which is engaged with a protrusion 17 within the housing 18 by firing the shaft portions 13*a* into the mounting holes 19 of the housing 18 with these portions being flexed in the directions shown by the arrows 28, and further by fitting the pawls 13*b* into the engaging holes 20.

The fixture B thus assembled can be installed to the copying machine 3 by inserting it in the direction shown by the arrow 4 from the upstream side in the paper feed direction, into a gap formed between the paper feed roller 8 and the body 3*a* when the stack table 9, that is detachably installed to the body 3*a* in the direction shown by the arrow 10, is removed to open the frame 7.

The stack table 9 is then replaced to the body 3*a* with the handle 23 of said stack holder 15 located below the stack table 9.

In the fixture arrangement thus constructed as shown above, when the friction pad 12 is required to be replaced due to its excessive abrasion exceeding the specified amount, or to be replaced with the one having a different coefficient of friction for changing the kind of paper to be used, an operator will follow the steps shown below: First of all, the operator removes the stack table 9 from the body 3*a* of the copying machine 3 and makes a gap between said friction pad 12 and the paper feed roller 8 by opening the frame 7 as shown in FIG. 1. The operator then gets hold of the handle 23 of the stack holder 15 and pulls it in the direction shown by the arrow 5 to easily remove the fixture B from the body 3*a*.

A new one of the fixture B is then installed to the body 3*a* by reversing above mentioned procedures for the removal, that is, by inserting it into the body 3*a* in the direction shown by the arrow 4, mounting the housing 18 of the stack holder 15 in the mounting opening 16, and engaging the hooks 24 with the end of the body 3*a*. Thus the friction pad 12 is replaced by way of changing the fixture B.

This makes it possible to take appropriate corrective actions for those faults including an abrasion in the friction pad 12, an abnormally noisy operation due to the worn neck portion 15*a* of the stack holder 15 caused by its frequent contact with the advancing feed roller 30, and a lowered paper feed ability. The pad holder 13 can, of course, individually be replaced.

The fixture B according to the present invention thus constructed may be replaced at the same time when an integrated unit comprising a developing device, cleaning device and the like in the copying machine, is replaced.

For selecting the fixture B various in coefficient of friction and pad pressure for the kind of paper, it is also feasible to prepare a plurality of sets of the fixture B which are composed of various combinations of the friction pad with different coefficients of friction and the spring with different compression pressures so that the optimum one of the fixture B can be selected and replaced according to the kind of copying paper to be used.

When only the pad pressure is required to be changed, the spring 14 may solely be replaced by removing the fixture B.

It should be understood that the loading and unloading direction of the fixture B for replacement of the friction pad 12 will not be limited to the direction shown in the description of the above embodiment, that is, parallel to the paper feed direction.

Since the feed roller 8 is mounted on the frame 7 of the copying machine 3 shown in the above described embodiment, there is formed a gap between the feed roller 8 and the friction pad 12 when the frame 7 is opened to make it easy to replace the friction pad 12. However, in the case of a copying machine of the kind in which there is formed no gap between these elements, a guide rail which slidably supports the fixture B may be provided for ease of its replacement.

What is claimed is:

1. In a friction pad fixture for urging a friction pad with pressure against the outer circumferential surface of a paper feed roller disposed in an image forming apparatus to prevent duplicated paper feed, said fixture comprising a first support member detachably mounted on the body of the image forming apparatus, a second support member for carrying said friction pad pivotally coupled to said body and a resilient means for urging respectively said second support member towards said paper feed roller and said friction pad against said paper feed roller and wherein a portion of said support member located upstream of a mounting portion of said second support member in the paper feed direction is made to keep in contact with an advancing feed roller.

2. A method for using a friction pad fixture for urging a friction pad with pressure against the outer circumferential surface of a paper feed roller disposed in an image forming apparatus to prevent duplicated paper feed, said fixture comprising a first support member detachably mounted on the body of the image forming apparatus, a second support member pivotally coupled to said body and for carrying said friction pad, resilient means for urging respectively said second support member toward said paper feed roller and said friction pad fixture against said paper feed roller, characterized by the step of replacing said friction pad fixture or said resilient means in accordance with the kind of paper to be fed and wherein a portion of said first support member located upstream of the mounting portion of said second support member in the paper feed direction is to keep in contact with an advancing feed roller.

* * * * *